US007827629B1

(12) United States Patent
Guillot

(10) Patent No.: US 7,827,629 B1
(45) Date of Patent: Nov. 9, 2010

(54) FOLDING FURNITURE STRUCTURE CONVERTIBLE BETWEEN A FOLDED SEATING CONDITION AND AN UNFOLDED SLEEPING CONDITION

(75) Inventor: Edmond Paul Guillot, Conover, NC (US)

(73) Assignee: Hickory Springs Manufacturing Company, Hickory, NC (US)

( * ) Notice: Subject to any disclaimer, the term of this patent is extended or adjusted under 35 U.S.C. 154(b) by 0 days.

(21) Appl. No.: 12/316,518

(22) Filed: Dec. 12, 2008

(51) Int. Cl.
*A47C 17/00* (2006.01)

(52) U.S. Cl. ..... 5/12.1; 5/28; 5/35

(58) Field of Classification Search ..... 5/13, 5/12.1, 103, 118, 2.1, 45, 35, 28, 27, 16; 296/69; 297/118
See application file for complete search history.

(56) References Cited

U.S. PATENT DOCUMENTS

| | | | | | |
|---|---|---|---|---|---|
| 826,994 | A | | 7/1906 | Conway | |
| 870,197 | A | * | 11/1907 | Phillipson | 5/42.1 |
| 1,240,500 | A | | 9/1917 | Sisbower et al. | |
| 1,374,661 | A | | 4/1921 | Hubbert | |
| 1,599,850 | A | | 9/1926 | Szabo et al. | |
| 2,677,831 | A | | 5/1954 | Göpert | 5/8 |
| 3,088,130 | A | * | 5/1963 | Walstad | 5/44.1 |
| 3,503,081 | A | * | 3/1970 | Mikos | 5/31 |
| 3,656,189 | A | | 4/1972 | Wiberg | 5/12 |
| 3,751,739 | A | * | 8/1973 | Assmann | 5/12.1 |
| 4,135,264 | A | * | 1/1979 | Busnelli | 5/45 |
| 4,204,287 | A | | 5/1980 | Lane et al. | 5/18 R |
| 4,205,405 | A | | 6/1980 | Hagney | 5/44 R |
| 4,239,281 | A | | 12/1980 | Lucá | 297/108 |
| 4,473,254 | A | * | 9/1984 | Secon | 297/118 |
| 4,523,342 | A | | 6/1985 | Poovey | 5/250 |
| 4,586,205 | A | | 5/1986 | Stevens | 5/13 |
| 4,590,630 | A | * | 5/1986 | Barabas | 5/13 |
| 4,625,347 | A | | 12/1986 | McElmurry et al. | 5/43 |
| 4,639,953 | A | | 2/1987 | McElmurry et al. | 5/43 |
| 4,692,952 | A | | 9/1987 | Dougher et al. | 5/37 R |
| 4,848,839 | A | | 7/1989 | Galardo | 297/440 |
| 5,138,727 | A | | 8/1992 | Hanes et al. | 5/13 |
| 5,295,275 | A | | 3/1994 | Sherman | 5/14 |

(Continued)

FOREIGN PATENT DOCUMENTS

EP 1 230 877 A1 8/2002

(Continued)

*Primary Examiner*—Robert G Santos
*Assistant Examiner*—Brittany M Wilson
(74) *Attorney, Agent, or Firm*—K&L Gates LLP

(57) ABSTRACT

A folding furniture structure for converting between a folded seating condition and an unfolded sleeping condition comprises a floor-supported base, and plural frame sections supported on the base. The frame sections include a first seat section fixed to the base in a horizontal orientation, a second seat section having one side pivotally connected to a forward side of the first seat section, and a seat back section pivotally connected to an opposite side of the second seat section. The frame sections are movable between the folded seating condition with the second seat section pivoted into overlying superposed face abutment to the first seat section and the seat back section extending angularly upwardly from the second seat section for use as a seat, and the unfolded sleeping condition with the second seat section and the seat back section aligned horizontally with the first seat section for use as a bed.

14 Claims, 6 Drawing Sheets

U.S. PATENT DOCUMENTS

| | | | | |
|---|---|---|---|---|
| 5,394,573 | A | 3/1995 | Laughlin et al. | 5/18.1 |
| 5,450,637 | A | 9/1995 | Hanes et al. | 5/13 |
| 5,505,513 | A | 4/1996 | Carsner | 296/69 |
| 5,787,522 | A | 8/1998 | Swihart | 5/45 |
| 5,855,030 | A | 1/1999 | Williams | 5/13 |
| 5,970,537 | A | 10/1999 | Hanes et al. | 5/13 |
| 6,035,465 | A | 3/2000 | Williams | 5/53.2 |
| 6,163,900 | A | 12/2000 | Stevenson | 5/118 |
| 6,286,159 | B1 | 9/2001 | Yang | 5/38 |
| 6,918,143 | B2 | 7/2005 | Wiberg | 5/45 |
| 7,073,217 | B2 | 7/2006 | Stevenson | 5/118 |
| 7,093,336 | B2 | 8/2006 | Grossman et al. | 29/434 |
| 7,246,393 | B2 | 7/2007 | Westendorf et al. | 5/706 |
| 2002/0130535 | A1 | 9/2002 | Dick et al. | 297/118 |
| 2006/0179566 | A1 * | 8/2006 | James et al. | 5/12.1 |
| 2009/0146469 | A1 * | 6/2009 | Reynolds et al. | 297/118 |

FOREIGN PATENT DOCUMENTS

| | | | |
|---|---|---|---|
| FR | 2 645 419 | A1 | 10/1990 |

* cited by examiner

FOLDING FURNITURE STRUCTURE CONVERTIBLE BETWEEN A FOLDED SEATING CONDITION AND AN UNFOLDED SLEEPING CONDITION

FIELD OF THE INVENTION

The present invention relates generally to folding furniture structures and, more particularly, to folding furniture structures which are convertible between a folded seating condition suitable for use as a seat and an unfolded sleeping condition suitable for use as a bed.

BACKGROUND OF THE INVENTION

Folding furniture structures of varying diverse constructions convertible between seating and bed configurations are well known and in widespread use, particularly for example so-called sofa sleepers or sofa bed structures having a frame mechanism movable between a folded condition suitable for seating use and an unfolded extended condition suitable for sleeping use. Apart from these general common characteristics, such convertible furniture structures employ many differing and varying forms of mechanical arrangements and also find equally diverse applications and end uses. For example, in addition to normal home usage of such convertible furniture, other common end use applications for convertible sofa bed or sofa sleeper structures are in vehicles, e.g., in recreational vehicles, campers, trailers and the like, and in hotels and motels, wherein space and utilitarian function can be at a premium. In particular, in such applications, the compactness of the overall structure and the ability of the mechanical arrangement to fold and unfold without requiring a clearance or spacing from an adjacent wall are desirable design features.

SUMMARY OF THE INVENTION

It is accordingly an object of the present invention to provide an improved folding furniture structure convertible between seating and sleeping conditions. A particular object of the present invention is to provide such a convertible furniture structure which is adapted for use in recreational and like vehicles, in hotels and motels, and in other environments wherein conservation of space is important. A further object of the invention is to provide a folding furniture structure having sufficient compactness to leave additional storage space within the structure especially when in its folded seating condition. A still further object of the invention is to provide such a folding furniture structure which does not require any clearance or spacing from an adjacent wall to accommodate folding and unfolding movements of the structure. Other objects and advantages of the invention will be apparent from the following disclosure.

Briefly summarized, the folding furniture structure of the present invention basically comprises a floor-supported furniture base and a plurality of frame sections supported on the base for relative folding and unfolding movement with respect to the base and to one another. The frame sections include a first seat section rigidly fixed to the base in a generally horizontal orientation. A second seat section has one side thereof pivotally connected to a forward side of the first seat section, and a seat back section is pivotally connected to an opposite side of the second seat section. The frame sections are moveable between a folded seating condition wherein the second seat section is pivoted into overlying superposed face abutment to the first seat section and the seat back section extends angularly upwardly from the second seat section for use as a seat, and an unfolded sleeping condition where in the second seat section and the seat back section are aligned horizontally with the first seat section for use as a bed.

In a preferred embodiment, each of the first and second seat sections and the seat back section has a respective rearward side and a respective forward side. The forward side of the first seat section is pivoted directly to the rearward side of the second seat section and the forward side of the second seat section is pivoted to the rearward side of the seat back section. The first seat section is rigidly fixed to the base in a generally horizontal seating orientation with its respective rearward side oriented rearwardly relative to the base and with the respective forward side of the first seat section oriented forwardly relative to the base. The second seat section is moveable pivotally relative to the rigidly fixed first seat section between a first generally horizontal disposition in the folding seated condition wherein the second seat section overlies the first seat section in superposed facing abutment therewith the respective forward side of the second seat section oriented to face substantially rearwardly of the base, and a second generally horizontal disposition in the unfolded sleeping condition wherein the second seat section extends forwardly of the first seat section in substantially horizontal alignment therewith. The seat back section is moveable pivotally relative to the second seat section and translationally relative to the first seat section between a generally upright disposition in the folded seating condition wherein the seat back section is disposed rearwardly relative to the base in generally upright angular relation to each of the first and second seat sections, and a generally horizontal disposition in the unfolded sleeping condition wherein the seat back section extends forwardly of the second seat section in substantially horizontal alignment with each of the first and second seat sections.

The base preferably comprises spaced opposing arm sections, with the first seat section being affixed between the arm sections. Furniture cushions are supported on the second seat section and the seat back section when the furniture structure is in the folded seating condition to facilitate use of the structure as a seat. The cushions may be removable when desired for unfolding of the frame sections into the unfolded sleeping condition of the structure. Alternatively, the cushions may be attached to the second seat section and the seat back section to move into a downwardly facing disposition on the undersides thereof when the frame sections are unfolded into the sleeping condition of the structure.

Preferably, the structure defines a storage space within the base beneath the first seat section when in the folded seating condition. An air mattress is preferably provided to be inflatable into a mattress configuration conforming to the dimensions of the frame sections in the unfolded sleeping condition of the structure and to be selectively deflateable into a storage configuration which can be folded with the frame sections of the structure into the seating condition.

A leg may be attached to the seat back section for movement between an operative position depending from the seat back section into floor contact when in the unfolded sleeping condition to support the frame sections and an inoperative position nested with the seat back section when in the folded seating condition.

The structure may also have a positioning stop element fixed relative to the base for abutment of the seat back section with the stop element when in the folded seating condition so as to position the seat back section relative to the first and second seat sections.

DETAILED DESCRIPTION OF THE PREFERRED EMBODIMENTS

Figure 1:
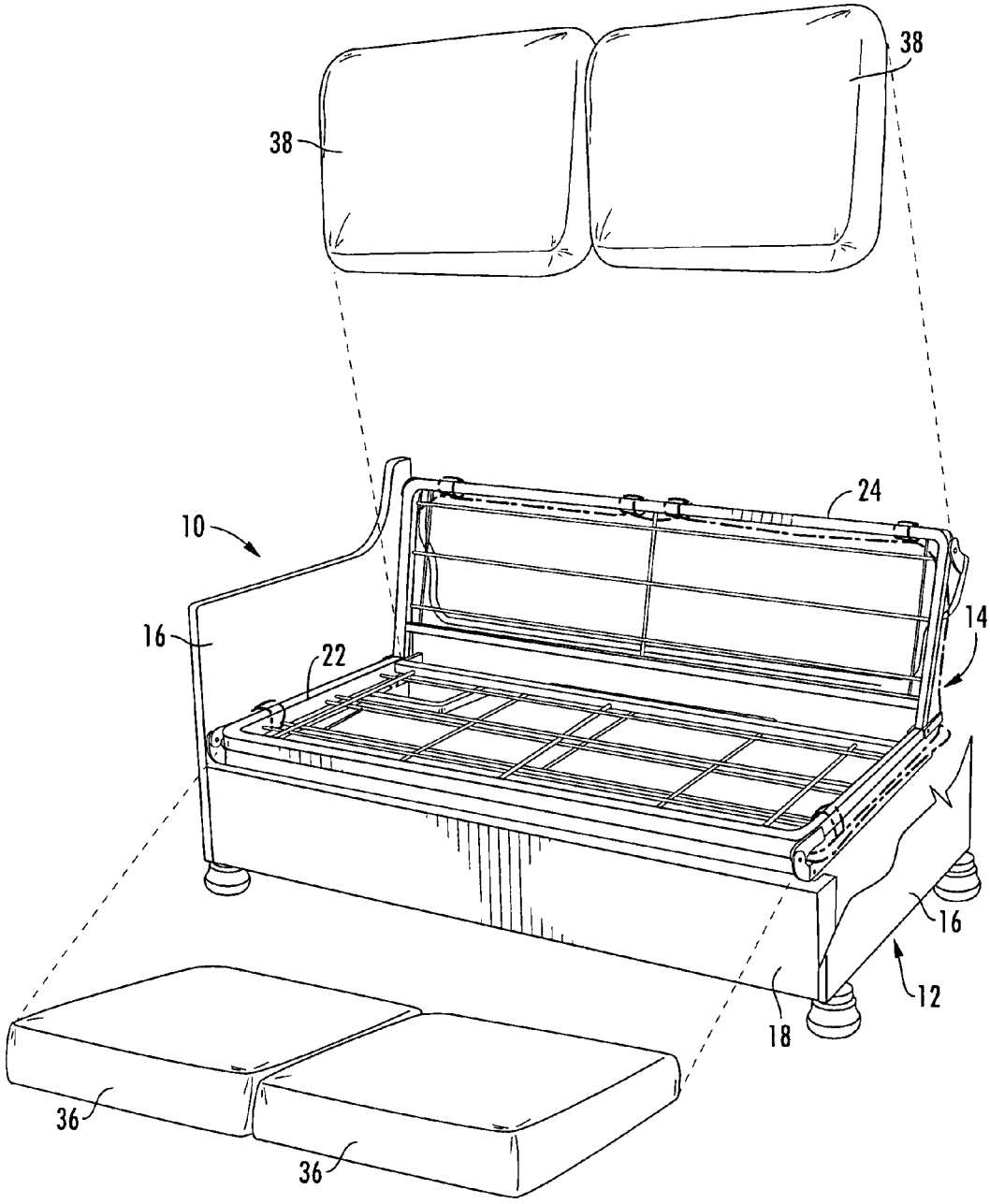
FIG. 1 is a perspective view of a folding convertible furniture structure in accordance with a preferred embodiment of the present invention, depicted in a fully folded seating condition.

Referring now to the accompanying drawings and initially to FIG. 1, a folding convertible furniture structure in accordance with a preferred embodiment of the present invention is indicated generally at 10 in a fully folded condition suitable for seating use. Basically, the furniture structure 10 comprises a furniture base, generally indicated at 12, within which is mounted a folding frame mechanism, generally indicated at 14.

The furniture base 12 essentially comprises the skeletal structure of a furniture seat, with opposed spaced-apart arm sections 16 in any desired form and configuration, and with at least a front transverse base section 18 affixed laterally between the forward lower sides of the arm sections 16. Optionally, a rear transverse base section (not shown) may also be provided to extend laterally between the rearward-most sides of the arm sections 16. Such skeletal structure of the furniture base 12 maybe of a dimension and configuration suitable for a single-person lounge chair or a multi-person seating unit such as a sofa or love seat. The respective sections of the furniture base 12 define an essentially open interior within which the frame mechanism 14 is mounted to extend transversely between the arm sections 16 interiorly behind the front transverse base section 18, as depicted in FIG. 1.

The frame mechanism 14 comprised three frame sections 20, 22, 24 (see also FIGS. 2-4) pivotably connected in end-to-end relation for relative folding and unfolding movement with respect to one another. Each frame section, 20, 22, 24 basically comprises a generally rectangular perimeter subframe 20A, 22A, 24A, respectively, supporting a wire grid 12B, 22B, 24B, respectively, transversely across and longitudinally along the subframe.

The frame section 20 is rigidly fixed at its opposite ends to the interior of the arm sections 16 to extend laterally therebetween in a substantially horizontal orientation with a rearward side 20A-R of the perimeter subframe 20A oriented adjacent the rearward side of the arm sections 16 and with a forward side 20A-F of the subframe 20A oriented adjacent the forward side of the arm sections 16 inwardly of the front transverse base section 18. The frame section 20 thereby forms a first seat section of the frame mechanism 14 to serve as a fixed lower seat support deck of the frame mechanism 14.

The frame section 22 has a rearward side 22A-R of its perimeter subframe 22A which is connected pivotably with respect to the forward side 20A-F of the frame section 20 by hinges 26 affixed between each frame section 20, 22 at their respective opposite ends. In turn, the frame section 24 has a rearward side 24 A-R of its perimeter subframe 24A which is connected pivotably with respect to the forward side 22A-F of the frame section 22 via hinges 28 affixed between the frame sections 22, 24 at their respective opposite ends. A U-shaped support leg 30 is pivoted to the frame section 24 laterally across the forward side 24A-F of its perimeter subframe 24A by hinge arms 32 affixed between the opposite ends of the forward subframe side 24A-F and the opposite ends of the U-shaped leg 30.

Figure 2:
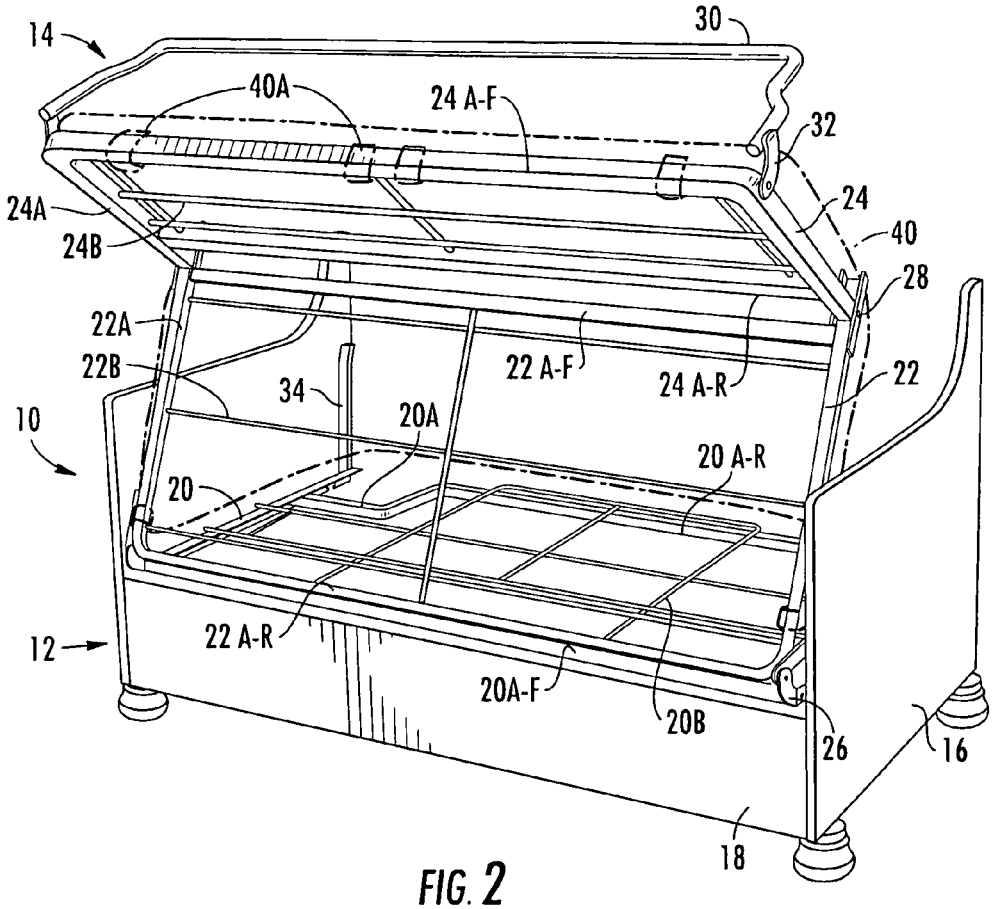
FIGS. 2-4 are perspective views, similar to FIG. 1, depicting the folding convertible furniture structure thereof in sequential steps of being converted into a fully unfolded sleeping condition depicted in FIG. 4.
Figure 3:
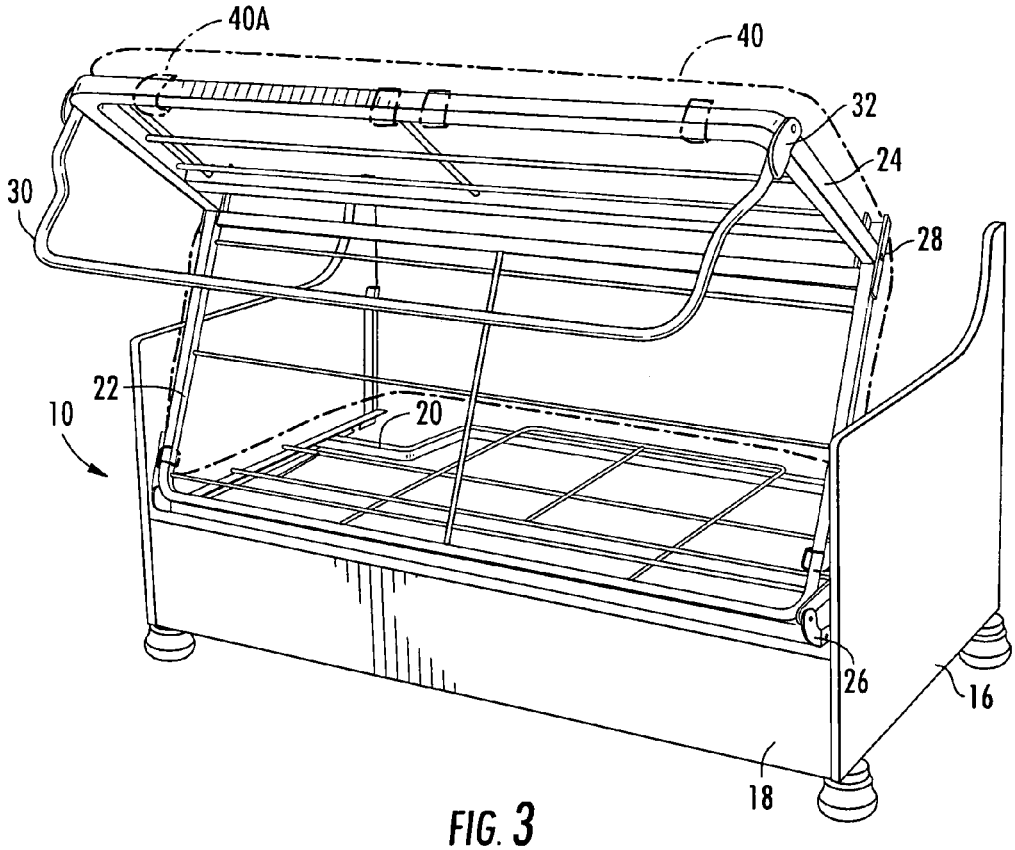
Figure 4:
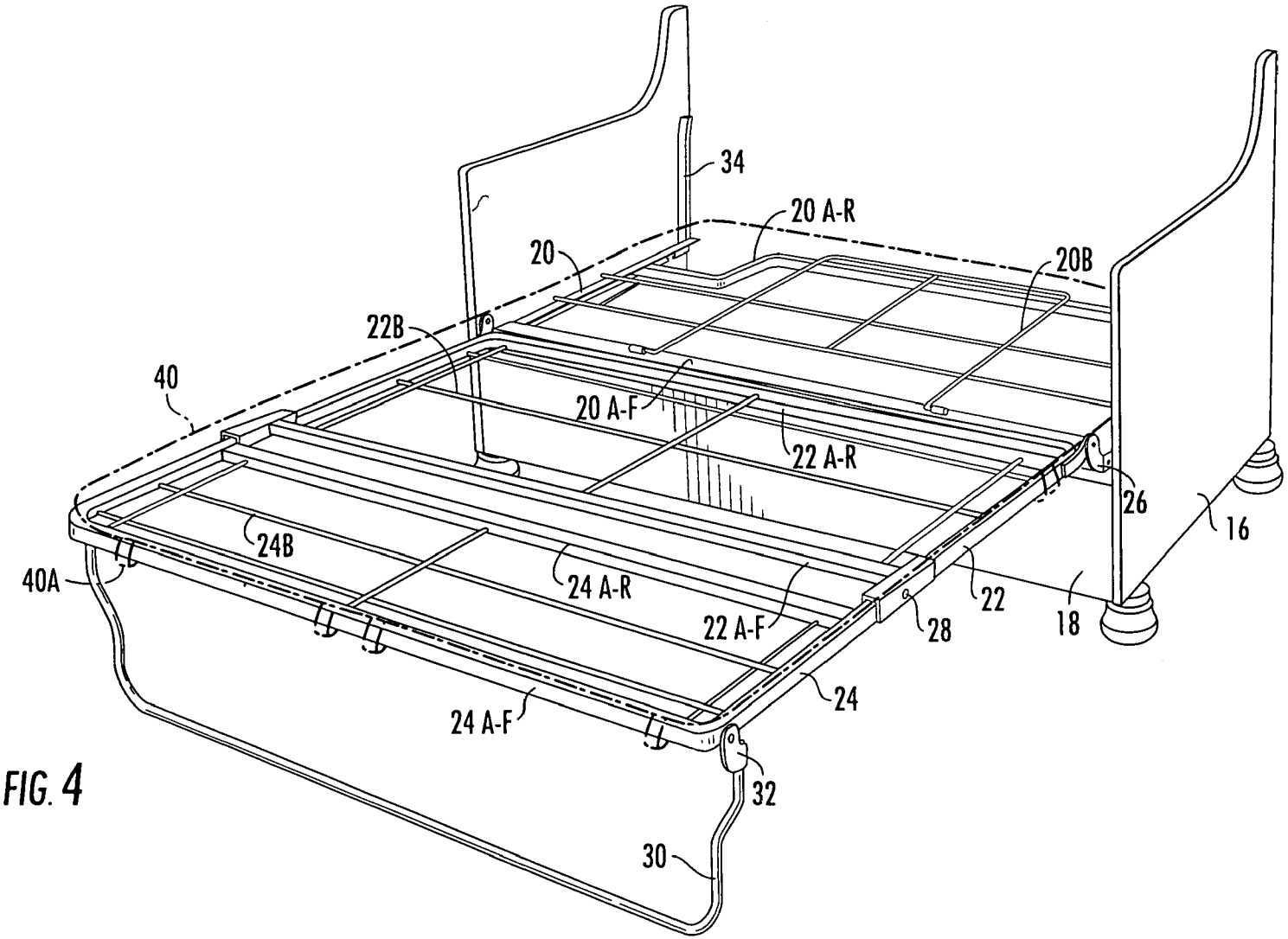

In this manner, the several frame elements of the frame mechanism 14 are adapted to fold relative to one another into a folded seating condition depicted in FIG. 1 wherein the furniture structure 10 is adapted for seating use and to unfold through steps depicted sequentially in FIGS. 2-4 into a fully unfolded condition depicted in FIG. 4 wherein the furniture structure 10 is adapted for sleeping use as a bed. More specifically, the pivotal connection of the frame section 22 to the frame section 20 enables the frame section 22 to move pivotably into a generally horizontal disposition when the furniture structure 10 in its fully folded seating condition, wherein the frame section 22 overlies the frame section 20 in superposed facing abutment with the frame section 20 to form a second seat section cooperating with the first seat section 20 for seating support. In such folded disposition of the frame section 22, its forward side 22A-F faces substantially rearwardly of the furniture base 12, generally overlying the rearward side 20A-R of the frame section 20.

The frame section 22 is pivotable from such folded disposition upwardly and forwardly relative to the frame section 20 and relative to the furniture base 12 through an essentially 180 degree range of motion, depicted at intermediate stages in FIGS. 2 and 3, into a second generally horizontal disposition, when the furniture structure is in its fully unfolded sleeping condition, wherein the frame section 22 extends forwardly of the frame section 20 in substantially horizontal alignment therewith, as depicted in FIG. 4. The hinges 26 between the frame sections 20, 22 have mating stop surfaces which prevent over-pivoting of the frame section 22 beyond alignment with the frame section 20 and thereby secure the frame sections in such unfolded disposition.

In turn, the frame section 24 is movable pivotably relative to the frame section 22 and thereby translationally relative to the frame section 20 into a disposition, when the furniture structure 10 is in the fully folded seating condition of FIG. 1, wherein the frame section 24 is disposed rearwardly relative to the furniture base 12 to extend in generally upright angular relation to each of the frame sections 20, 22. The frame mechanism 14 may include a stop bar 34 affixed to the interior surface of each arm section 16 rearwardly and upwardly adjacent to the frame section 20 in the angular upright disposition desired for the frame section 24, to provide a resting abutment surface for the frame section 24 to secure it in such upright angular disposition. The stop bars 34 may be formed as separate frame elements or may alternatively be formed as upright extensions of the perimeter subframe 20A of the frame section 20, as depicted in the preferred embodiment illustrated in the drawings.

The frame section 24 is moveable from such upright disposition by pivoting relative to the frame section 22 while moving translationally forward relative to the frame section 20, as depicted in FIGS. 2 and 3, into a generally horizontal disposition when the furniture structure 10 is in the fully unfolded sleeping condition of the FIG. 4, wherein the frame section 24 extends forwardly of the frame section 22 in substantially horizontal alignment with each of the frame sections 20 and 22. The hinges 28 between the frame sections 22 and 24 include stop surfaces which prevent over-pivoting of the frame section 24 and thereby secure the frame section 24 in such horizontal alignment.

In the course of the above-described pivoting motion of the frame section 24, the leg 30 may be pivoted from a storage disposition nested against the surface of the grid 24B of the frame section 24 which faces rearwardly in the folded condition of the furniture structure 10, through an essentially 270 degree range of motion via the hinge arms 32 into a disposition extending generally perpendicularly from the frame section 24 to contact the floor surface on which the furniture structure 10 is supported, thereby to provide support for the frame sections outboard of the furniture base 12.

Thus, in the folded seating condition of the furniture structure 10 shown in FIG. 1, the horizontally-oriented overlying superposed frame sections 20, 22 form first and second seat frame sections which together serve as a horizontal seating support for seated occupants of the furniture structure, while the frame section 24 in its angularly-oriented upright disposition forms a seat back frame section to provide back support for seated occupants on the furniture structure 10. In the unfolded extended condition of the furniture structure 10, the frame sections 20, 22, 24 in their end-to-end horizontal alignment collectively form an extended sleeping surface for use of the furniture structure 10 as a bed to support occupants in a reclined or supine disposition. In such unfolded sleeping condition of the furniture structure 10, the frame section 20 (i.e., the first lowermost seat frame section in the folded condition) forms the head end of the sleeping surface, while the frame section 22 (which forms the second upper seat frame section in the folded condition) forms an intermediate bed section, and the frame section 24 (which forms the seat back frame section in the folded condition) forms the leg and foot section of the bed surface.

As depicted in FIG. 1, seat and seat back cushions 36, 38 are supported on the upper surface of the second seat frame section 22 and the forward surface of the seat back frame section 24 when the furniture structure 10 is in its folded seating condition to provide comfortable cushioning between occupants and the frame mechanism 14. The cushions 36, 38 may be of any suitable conventional form of construction, typically a compressible foam or fiber body covered with an upholstery material. The cushions 36, 38 may be removable from the frame mechanism 14 prior to unfolding into the extended sleeping condition, as depicted in the drawings. Alternatively, since the upwardly-surface of the seat frame section 22 and the forwardly-surface of the seat back frame section 24 face downwardly in the unfolded sleeping condition of the frame mechanism 14, the cushions 36, 38 may be affixed to such frame sections 22, 24 so as to remain attached to the underside of the frame mechanism 14 in the unfolded sleeping condition (not shown).

Also, the cushions, 36, 38 may be of any suitable configuration, to cover the frame mechanism 14 in the folded condition thereof. For example, the seat cushions 36 may be provided with a forwardly curved lip portion (not shown) to cover the hinged sides 20A-F, 22A-R of the frame sections 20, 22 which are disposed forwardly above the front transverse base section 18 of the furniture structure 10 in such folded condition, thereby to provide an aesthetically pleasing appearance to the furniture structure 10 in the folded condition, without any components of the frame mechanism 14 being exposed or visible, and also to promote comfortable seating use of the furniture structure 10. Similarly, the seat back cushions 38 may be provided with a curved lip portion (also not shown) to cover the upwardly disposed side 24A-F of the seat back frame section 24 in the folded condition.

For sleeping use of the furniture structure 10 in the unfolded sleeping condition of FIG. 4, an inflatable air mattress 40 is attached to the frame mechanism 14 via straps 40A which extend from edges of the air mattress to encircle lateral portions of the perimeter subframe 22A of the frame section 22 and the forward side 24A-F of the subframe 24A of the frame section 24. The air mattress 40 is preferable in the form of an inflatable air bladder only, with no internal springs, foam or other elements within the bladder which would create additional thickness in the air mattress 40 when in a fully deflated condition. Thus, the air mattress 40, when fully deflated, will reside in a partially folded condition between the two abutting seat frame sections 20, 22 and between the seatback section 24 and the leg 30 pivoted thereto when the frame mechanism 14 is folded into the seating condition of FIG. 1, without the air mattress 40 restricting the ability of such frame elements to fully fold together.

Figure 6:
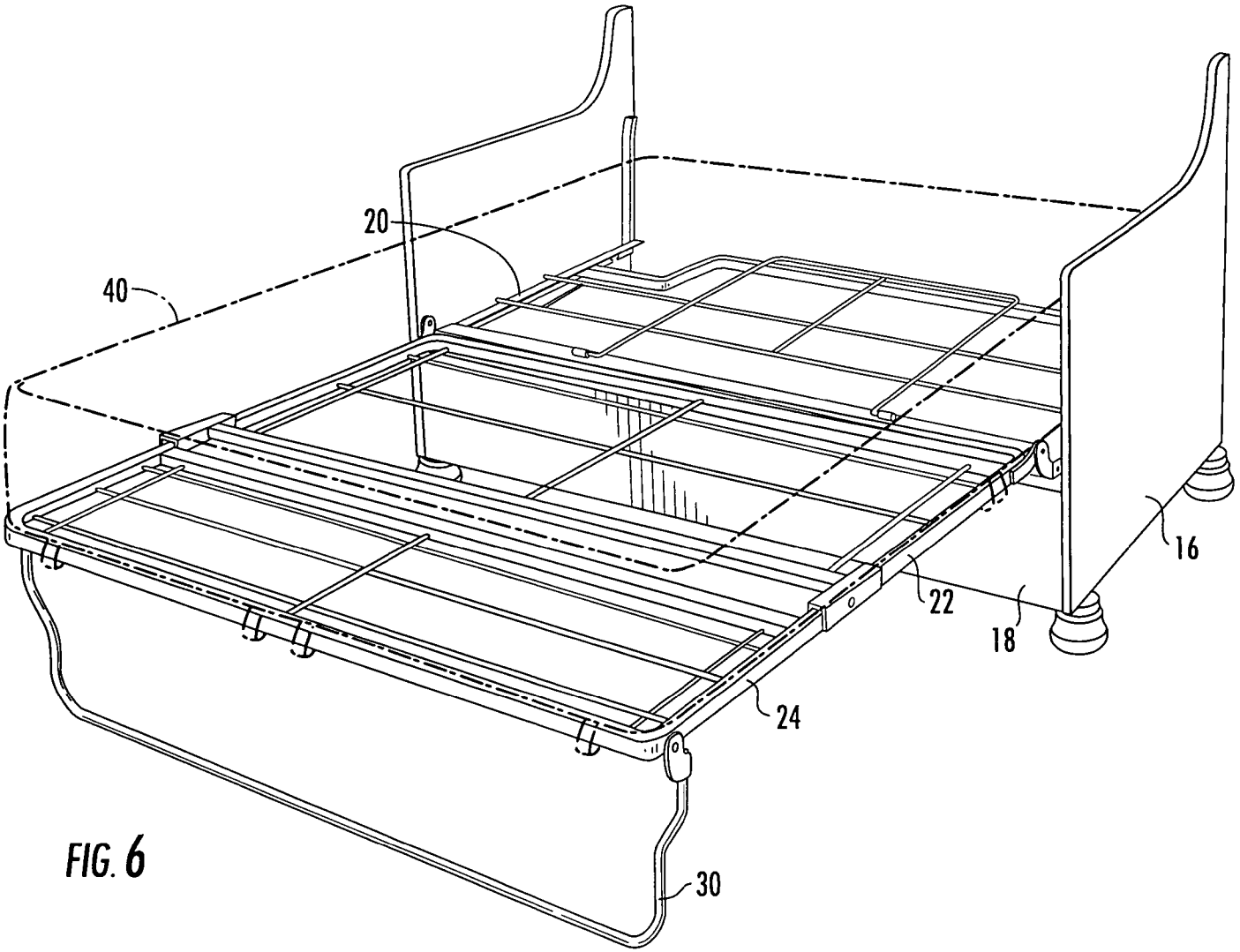
FIG. 6 is another perspective view, similar to FIG. 4, depicting the furniture structure in the fully unfolded sleeping condition with the air mattress fully inflated for sleeping use.

When the frame mechanism 14 is unfolded into the sleeping condition of FIG. 4, the air mattress 40 correspondingly unfolds to rest in its deflated condition essentially coextensively along and across the frame sections 20, 22, 24, as depicted in FIG. 4, whereby the air mattress 40 may then be conveniently inflated to facilitate comfortable use of the furniture structure 10 as a bed for sleeping. The air mattress 40 may be advantageously provided with an integrated motorized two-way air pump to conveniently facilitate pressurized inflation and vacuum induced deflation of the air mattress as desired. FIG. 6 depicts the air mattress 40 in a fully inflated condition ready for sleeping use.

Figure 5:
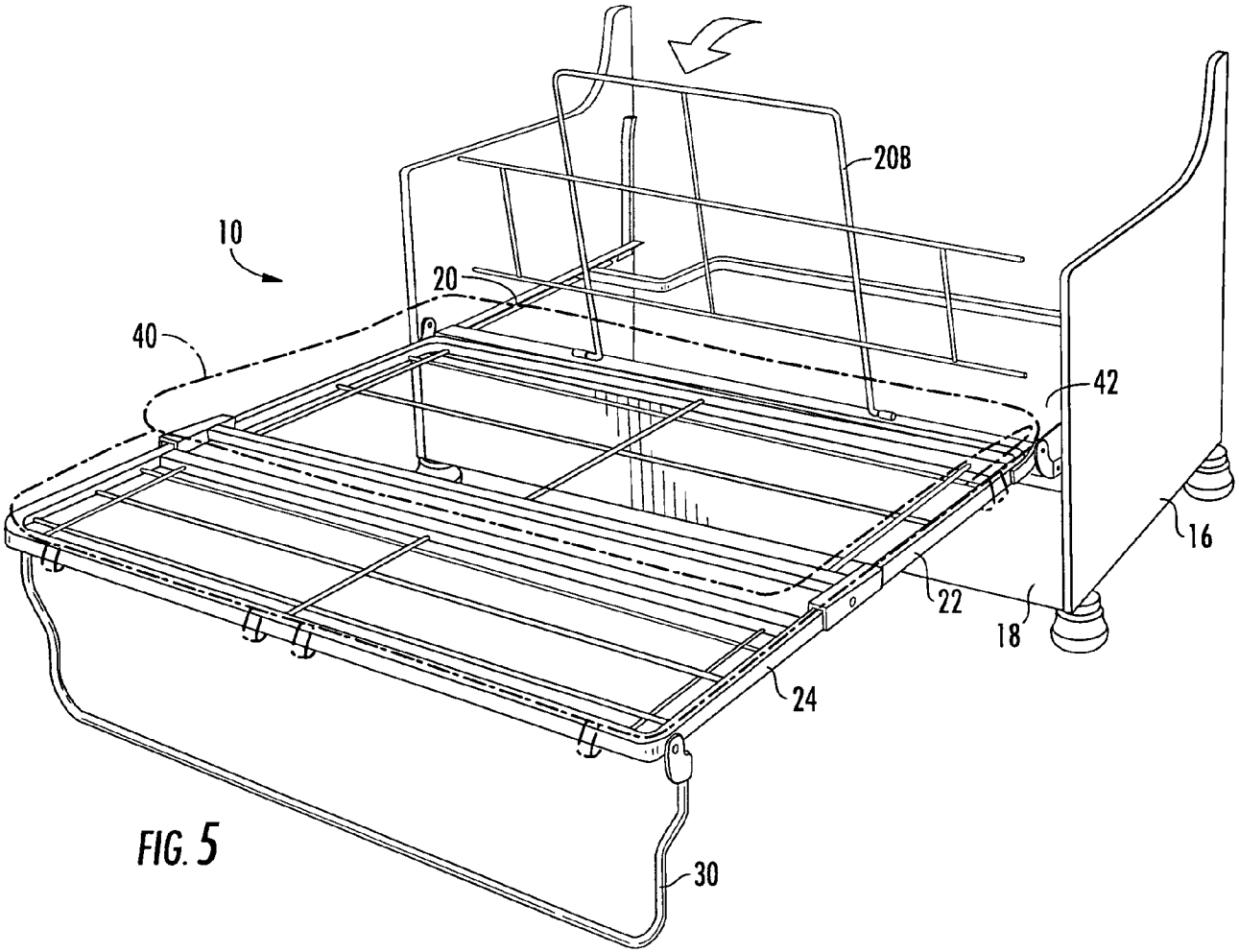
FIG. 5 is another perspective view, similar to FIG. 4, depicting access to the storage space beneath the furniture structure in the fully unfolded sleeping condition depicted in FIG. 4.

As will be recognized, the area within the furniture base 12 beneath the fixed first seat frame section 20 is unoccupied laterally between the arm sections 16, whereby such unoccupied space may advantageously be utilized for hidden storage. To provide convenient access to and from such storage space, the grid 20B of the first seat frame section 20 may advantageously be pivoted to the forward side 20A-F of the perimeter subframe 20A, but other wise be configured to overly the perimeter subframe 20A unattached thereto. In this manner, when the frame mechanism 14 is in its fully unfolded sleeping condition and with the air mattress remaining deflated, the air mattress may be folded forwardly to expose the grid 20B which may then be pivoted upwardly for ready access into the storage space 42 through the thusly exposed opening within the perimeter subframe 20A, as depicted in FIG. 5.

The folding convertible furniture structure 10 of the present invention will thus be understood to offer several advantages and conveniences. The frame mechanism 14 is of a simplified mechanical structure without complicated linkages, springs, and the like typical of other conventional sofa bed mechanisms. Thus, the frame mechanism 14 is of relatively light weight and easy to manipulate between the folded and unfolded conditions. The simplified mechanical arrangement also facilitates a more compact footprint for the mechanism enabling the overall furniture structure 10 to have a correspondingly compact footprint, which is advantageous for use of the furniture structure 10 in environments wherein floor space is at a premium, such as in recreational vehicles or campers, but also in other diverse environments such as hotels and motels. The folding and unfolding motion executed by the frame mechanism 14 also advantageously does not require that the furniture structure 10 have any spacing or clearance from an adjacent wall to facilitate the folding and unfolding movements, which further promotes efficient utilization of floor space in the area occupied by the furniture structure 10.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A folding furniture structure for converting between a folded seating condition suitable for use as a seat and an unfolded sleeping condition suitable for use as a bed, the furniture structure comprising:

a floor-supported furniture base, and a plurality of frame sections supported on the base, the frame sections including a first seat section rigidly fixed to the base in a generally horizontal orientation, a second seat section having one side pivotally connected directly to a forward side of the first seat section without intervening frame structure therebetween, and a seat back section pivotally connected to an opposite side of the second seat section, the frame sections being movable between the folded seating condition wherein the second seat section is pivoted into overlying direct superposed face abutment to the first seat section and the seat back section extends angularly upwardly from the second seat section for use as a seat, and the unfolded sleeping condition wherein the second seat section and the seat back section are aligned horizontally with the first seat section for use as a bed.

2. A folding furniture structure according to claim 1, wherein the base comprises spaced opposing arm sections, the first seat section being affixed between the arm sections.

3. A folding furniture structure according to claim 1, further comprising furniture cushions supported on the second seat section and the seat back section in the folded seating condition.

4. A folding furniture structure according to claim 1, further comprising a storage space within the base beneath the first seat section.

5. A folding furniture structure according to claim 1, further comprising an air mattress inflatable into a mattress configuration conforming to the dimensions of the frame sections in the unfolded sleeping condition and deflatable into a configuration conformable to be folded within the frame sections in the folded seating condition.

6. A folding furniture structure according to claim 1, further comprising a leg attached to the seat back section for movement between an operative position depending from the seat back section into floor contact in the unfolded sleeping condition for supporting the frame sections and a inoperative position nested with the seat back section in the folded seating condition.

7. A folding furniture structure according to claim 1, further comprising a positioning stop element fixed relative to the base for abutment therewith of the seat back section in the folded seating condition for positioning of the seat back section relative to the first and second seat sections.

8. A folding furniture structure for converting between a folded seating condition suitable for use as a seat and an unfolded sleeping condition suitable for use as a bed, the furniture structure comprising:

a floor-supported furniture base, and a plurality of frame sections supported on the base, the frame sections including a first seat section, a second seat section, and a seat back section pivotally connected in end-to-end relation, each of the first seat section, the second seat section, and the seat back section having a respective rearward side and a respective forward side, the forward side of the first seat section being pivoted directly to the rearward side of the second seat section without intervening frame structure therebetween and the forward side of the second seat section being pivoted to the rearward side of the seat back section, the first seat section being rigidly fixed to the base in a generally horizontal seating orientation with the respective rearward side of the first seat section oriented rearwardly relative to the base and with the respective forward side of the first seat section oriented forwardly relative to the base, the second seat section being movable pivotably relative to the first seat section between a first generally horizontal disposition in the folded seating condition wherein the second seat section overlies the first seat section in superposed direct facing abutment therewith the respective forward side of the second seat section oriented to face substantially rearwardly of the base and a second generally horizontal disposition in the unfolded sleeping condition wherein the second seat section extends forwardly of the first seat section in substantially horizontal alignment therewith, and the seat back section being movable pivotably relative to the second seat section and translationally relative to the first seat section between a generally upright disposition in the folded seating condition wherein the seat back section is disposed rearwardly relative to the base in generally upright angular relation to each of the first and second seat sections and a generally horizontal disposition in the unfolded sleeping condition wherein the seat back section extends forwardly of the second seat section in substantially horizontal alignment with each of the first and second seat sections.

9. A folding furniture structure according to claim 8, wherein the base comprises spaced opposing arm sections, the first seat section being affixed between the arm sections.

10. A folding furniture structure according to claim 8, further comprising furniture cushions supported on the second seat section and the seat back section in the folded seating condition.

11. A folding furniture structure according to claim 8, further comprising a storage space within the base beneath the first seat section.

12. A folding furniture structure according to claim 11, further comprising an air mattress inflatable into a mattress configuration conforming to the dimensions of the frame sections in the unfolded sleeping condition and deflatable into a configuration conformable to be folded within the frame sections in the folded seating condition.

13. A folding furniture structure according to claim 8, further comprising a leg attached to the seat back section for movement between an operative position depending from the seat back section into floor contact in the unfolded sleeping condition for supporting the frame sections and an inoperative position nested within the seat back section in the folded seating condition.

14. A folding furniture structure according to claim 8, further comprising a positioning stop element fixed relative to the base for abutment therewith of the seat back section in the folded seating condition for positioning of the seat back section relative to the first and second seat sections.

* * * * *